United States Patent [19]

Forrest

[11] Patent Number: 4,635,419

[45] Date of Patent: Jan. 13, 1987

[54] VENTED ROOF CONSTRUCTION

[76] Inventor: Joseph C. Forrest, Box 154, Somerset, Wis. 54025

[21] Appl. No.: 799,801

[22] Filed: Nov. 20, 1985

Related U.S. Application Data

[63] Continuation-in-part of Ser. No. 494,642, May 16, 1983, abandoned.

[51] Int. Cl.[4] ..... E04B 1/70

[52] U.S. Cl. ..... 52/303; 98/31

[58] Field of Search ..... 52/302, 303, 92, 95, 52/199, 405, 407, 408; 98/31, 32

[56] References Cited

U.S. PATENT DOCUMENTS

| | | | |
|---|---|---|---|
| 475,593 | 5/1892 | Millard | 52/407 |
| 2,264,961 | 12/1941 | Ward | 52/303 |
| 2,645,824 | 7/1953 | Titsworth | 52/407 |
| 3,343,474 | 9/1967 | Sohda et al. | 98/31 |
| 3,368,473 | 9/1967 | Sohda et al. | 98/31 |
| 3,797,180 | 3/1974 | Grange | 52/199 |
| 4,015,381 | 4/1977 | Schmidt | 52/199 |
| 4,254,598 | 3/1981 | Rogroden | 52/95 |
| 4,295,415 | 10/1981 | Schneider | 52/303 |
| 4,446,661 | 5/1984 | Jonsson et al. | 52/95 |

*Primary Examiner*—James L. Ridgill, Jr.
*Attorney, Agent, or Firm*—John W. Adams

[57] ABSTRACT

A roof construction provided with a series of vented air circulation passages between the outer roofing layer and an inner sealed insulation layer to provide a positive ventilating system and prevent accumulation of moisture within the insulated inner portion of the roof structure.

7 Claims, 10 Drawing Figures

VENTED ROOF CONSTRUCTION

This application is a continuation in part of application No. 494,642 filed May 16, 1983, now abandoned.

BACKGROUND OF THE INVENTION

It is a major problem in cold climates to prevent condensation within the insulated ceiling structure of moisture condensed from the hot, moist inside air within the building. This is particularly true in vaulted interior ceiling constructions where frequently, there is insufficient vented air circulation provided between the insulated portion of the roof structure and the cold outside exposed roofing layer.

The present invention provides a double layer construction with cold vented air circulation passage means between the insulation and the outer roofing layer.

SUMMARY OF THE INVENTION

This invention consists in the provision of a plurality of air spaces extending inwardly from the outer edges of the roof with venting means at the ends of said passages to provide constant air circulation through the passages to eliminate accumulation of condensed moisture on the outer surface of the insulating layer and thus, prevent water damage within the insulated and finished interior portion of the roof structure.

DETAILED DESCRIPTION

Figure 1:
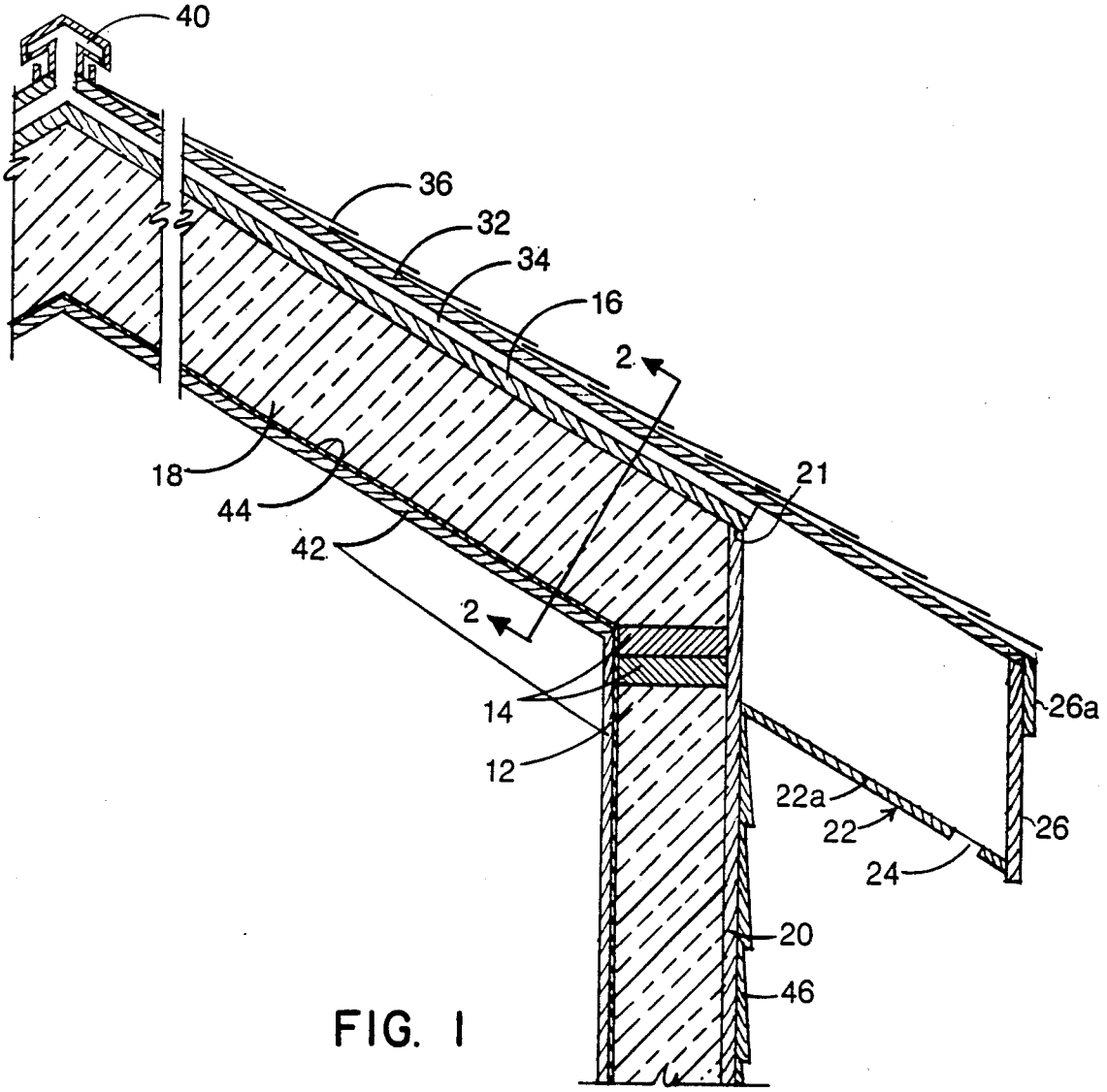
FIG. 1 is a fragmentary transverse sectional view of a vaulted ceiling roof structure embodying this invention.
Figure 2:
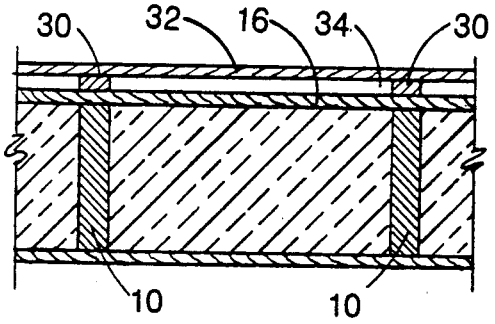
FIG. 2 is a sectional view taken substantially along the line 2—2 of FIG. 1.

FIGS. 1 and 2 show a vaulted interior ceiling construction embodying the present invention. In the structure shown, gabled rafters 10 are provided in conventional spaced-apart relation to support the roof structure. These are supported at the outside walls by upright stud members 12 which are in turn supported at the bottom ends in a conventional manner on a suitable foundation (not shown). The top ends of the studs are connected by suitable plate members 14 and the rafters 10 are notched and fixed to the plate 14 in the conventional manner. A layer of intermediate sheeting is provided such as the insulation board 16 which is illustrated and which is secured to the outer edges of the rafters as by being nailed thereto in the conventional manner. Insulation material 18 is packed between adjacent rafters and is sealingly enclosed on the outside by the roof sheeting layer 16 and the vertical wall insulation board sheeting layer 20. The sheets of insulation board 20 forming the wall sheeting layer are notched to tightly surround and engage each rafter and the upper ends of the wall sheeting board 20 are beveled to sealingly engage the bottom surface of the roof insulation board 16 as shown at 21 in FIG. 1. The rafters 10 extend outwardly beyond the vertical side walls and to form the overhanging eave section 22 to which the soffit board **22*a* is attached. A continuous vent opening 24 is provided adjacent the outer marginal edge portion of the soffit 22*a*. A facia board 26 extends across the outer beveled ends of the rafters 10 as shown and a trim strip 26*a*** is provided in the upper portion thereof.

Firring strips 30 overlie the insulation board 16 and in the form shown, are aligned with the rafters 10 as best shown in FIG. 2. Roof sheeting boards such as the plywood sheets 32 are mounted over the firring strips 30 to form vent passages 34 between the outer sheeting layer 32 and the insulation board layer 16. These vent passages communicate at their lower ends with the eave vent areas defined between the adjacent joists 10 with the vent openings 24 communicate directly. A layer of conventional roofing material such as the layer of shingles 36 covers the outside sheeting layer 32 in a conventional manner. The upper ends of the passages 34 are vented by means of a ridge vent unit 40 which is fixed in overlying relation to the layer of shingles 36 and sheeting layer 32, both of which terminate in slightly spaced relation to the apex of the gable ridge as shown to form inner vent openings for the passages 34.

The inside surface may be finished in a conventional manner such as by drywall plasterboard sheets 42 and a vapor barrier 44 is provided in a conventional manner between the plasterboard and the insulation. This vapor barrier 44 and plasterboard drywall system 42 may also be provided on the inside of the vertical stud walls. Suitable exterior finish may be provided on the vertical side walls such as the siding 46 shown in FIG. 1.

Figure 3:
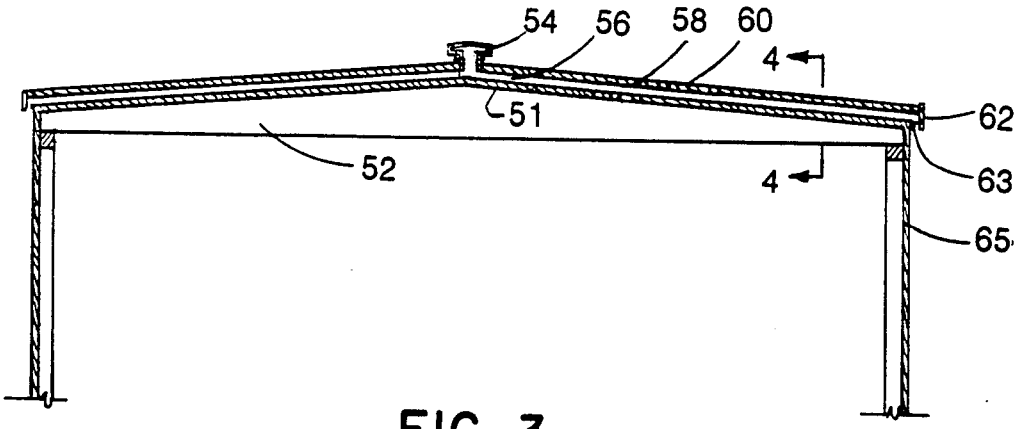
FIG. 3 is a transverse sectional view of a house trailer roof design embodying the invention.
Figure 4:
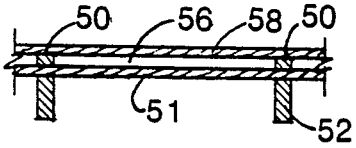
FIG. 4 is a vertical sectional view taken substantially along the line 4—4 of FIG. 3.

A modified configuration of the invention is illustrated in FIGS. 3 and 4 which show a generally similar venting construction particularly adapted for mobile homes which normally have a very flat pitch on the roof. In order to produce the vent space necessary to prevent condensation in the insulated roof structure of the mobile home, spaced-apart firring strips 50 are laid over the top of an insulated sheathing layer 51. These strips 50 run parallel to the roof rafters 52 and preferably overlie the same. A center ridge vent 54 may be provided as disclosed in the first form of the invention shown in FIGS. 1 and 2, and the ends of the vent passages 56 formed between the firring strips 50 are afforded communication with the ridge vent 54 as described in connection with the previous form of the invention. The outer roof structure includes a layer of plywood sheeting 58 applied over the firring strips 50 to enclose the vent passages 56 and provide support for conventional weatherproof roofing material 60. The outer eave vents may be formed by sheet metal flashing provided along the outer marginal edges of the roofing and bent downwardly to form continuous flange elements 62 spaced outwardly from the conventional vertical wall structure 65. A continuous screen may be provided to cover the continuous vent opening 63 formed between the flange **62*a*** and the upper corner of the wall.

Figure 5:
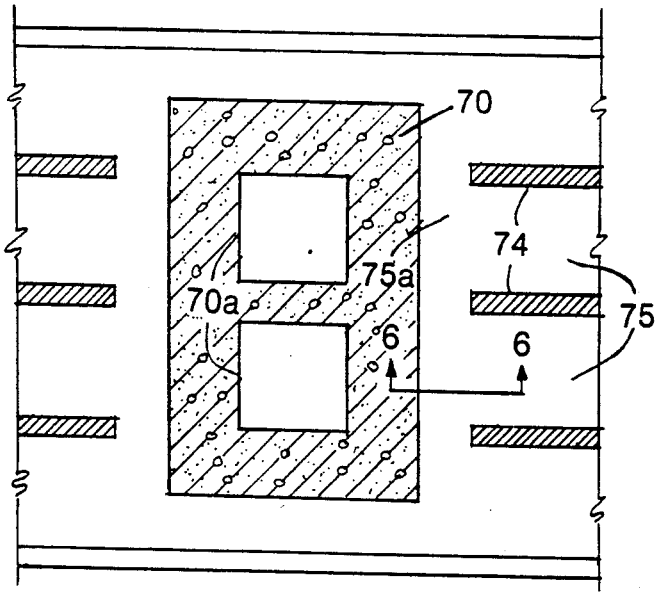
FIG. 5 is a horizontal sectional view taken substantially along the line 5—5 of FIG. 6.
Figure 6:
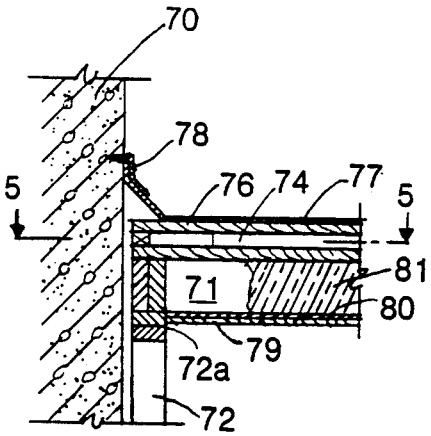
FIG. 6 is a fragmentary sectional view taken substantially along the line 6—6 of FIG. 5.

In FIGS. 5 and 6, a further modification of the invention is shown. In this modification, communicating vent passages are provided around an obstruction such as the chimney 70 having flues **70*a*. A flat roof structure is shown having the joists 71 supported on studs 72 having a double plate 72*a* on the top thereof. A sealing deck layer 73 is supported on the joists 71 and firring strips 74 are mounted thereon in spaced-apart relation to provide ventilating passages 75 therebetween. The firring strips overlie the joists 71 to provide the required support therefor. Upper deck sheets such as plywood decking 76 overlie the strips 74 and suitable roofing such as the metal roof 77 is provided. Suitable flashing 78 provides the necessary seal between the chimney masonry and the roof decking 77. The firring strips 74 terminate in spaced relation to the vertical wall surface of the chimney 70 as best shown in FIG. 5 to provide communication passages 75***a* to complete the ventilating system between the insulated inner roof structure and the outer roof decking 76 and roofing 77. The inner finished ceiling 79 provided with a sealing barrier 80 of standard construction, is provided and insulation 81 is packed between the joists 71 as shown.

It will be seen that this invention provides a roof construction with a ventilating system between the outer cold air roof structure and the inner insulated roof structure which will positively prevent the accumulation of moisture which may condense on the outer surface of the insulated inner roof structure.

Figure 7:
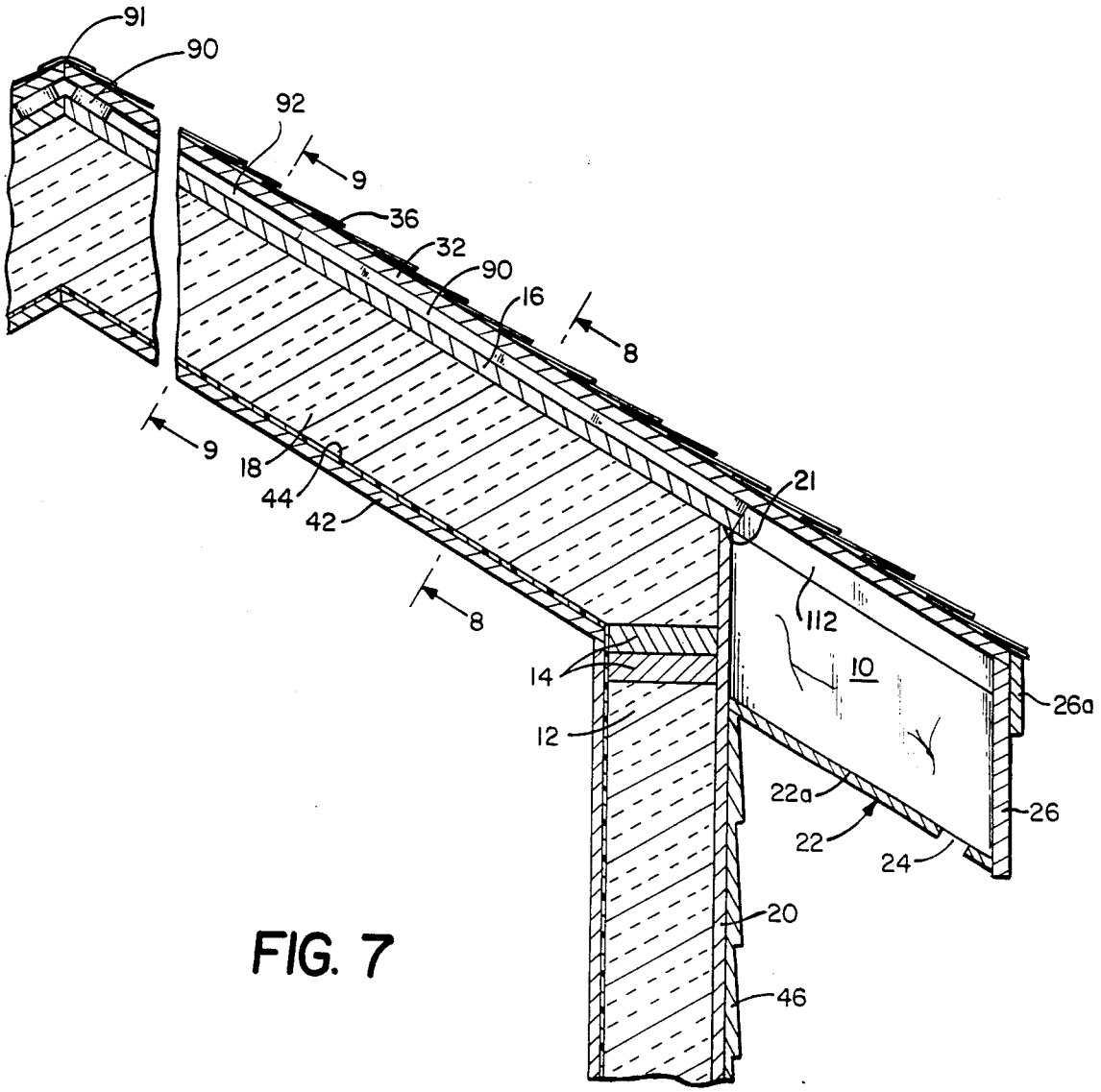
Figure 8:
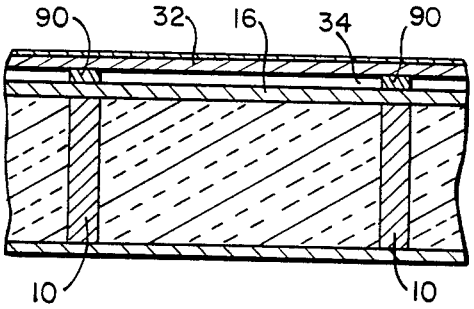
Figure 9:
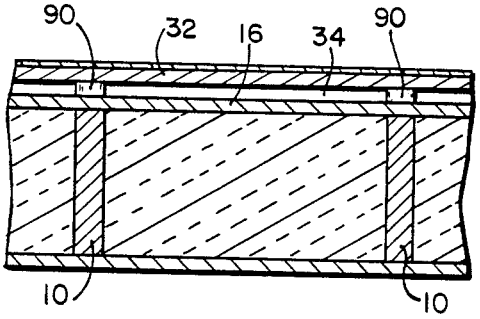

FIGS. 7, 8 and 9 disclose another modification of this invention in which the upper roof vent has been eliminated. It has been found that sufficient circulation of outside air can be produced by providing direct communication between adjacent vent spaces to permit the outside air to flow freely under the entire roof surface and maintain the entire roof surface at substantially the same temperature as the outside air and thus, avoid the ice build-up caused by melting of the snow on the roof and subsequent freezing thereof as the water runs down under the snow even in below freezing temperatures.

The ridge vent construction previously disclosed herein frequently permits snow to blow into the vent air space and thus, provide a source of water which can reach the interior roof structure and cause damage to the interior finished ceiling and in addition, has created other problems such as the unsightly appearance at the peak of the roof. For these reasons, it is desirable to eliminate this ridge vent or other vents on the roof surface, since sufficient circulation throughout the entire air space has been produced to solve the freezing problem described herein.

Referring to FIGS. 7, 8 and 9, similar reference numerals have been applied to the various roof components as those disclosed in FIGS. 1 and 2, wherein rafters 10 are illustrated along with wall stud members 12 having suitable plate members 14 mounted on top thereof and wall sheeting board 20. Insulation material 18 is packed between the rafters and is sealingly enclosed by the roof sheeting layer 16 which is joined with the vertical wall sheeting board 20 at 21 as previously described. Overhanging eaves 22 are provided with an outer soffit board 22*a* and a facia board 26 with a trim strip 26*a* attached at the outer ends of the rafters 10. A continuous vent opening 24 is provided along the outer edge of the soffit 22*a*.

In this form of the invention (shown in FIGS. 7–9) spacer-firring strips 90 are installed over the sheeting board 20 in registration above the rafters 10 as illustrated. These spacer-firring strips extend from the outer building wall surface above the juncture of the roof and wall insulation board at 21 to an elevation spaced downwardly from the ridge of the roof designated by the numeral 91, thus providing a cross ventilation passages 92 between the adjacent ventilation passages 34 formed by the strips 90. Outer sheeting such as the plywood layer 32 overlies the strips 90 in the same manner previously described in connection with FIGS. 1 and 2, except for the cross communication passages 92 between adjacent passages 34. These strips 90 provide a supporting structure for the conventional roof shingles 36 as illustrated.

Figure 10:
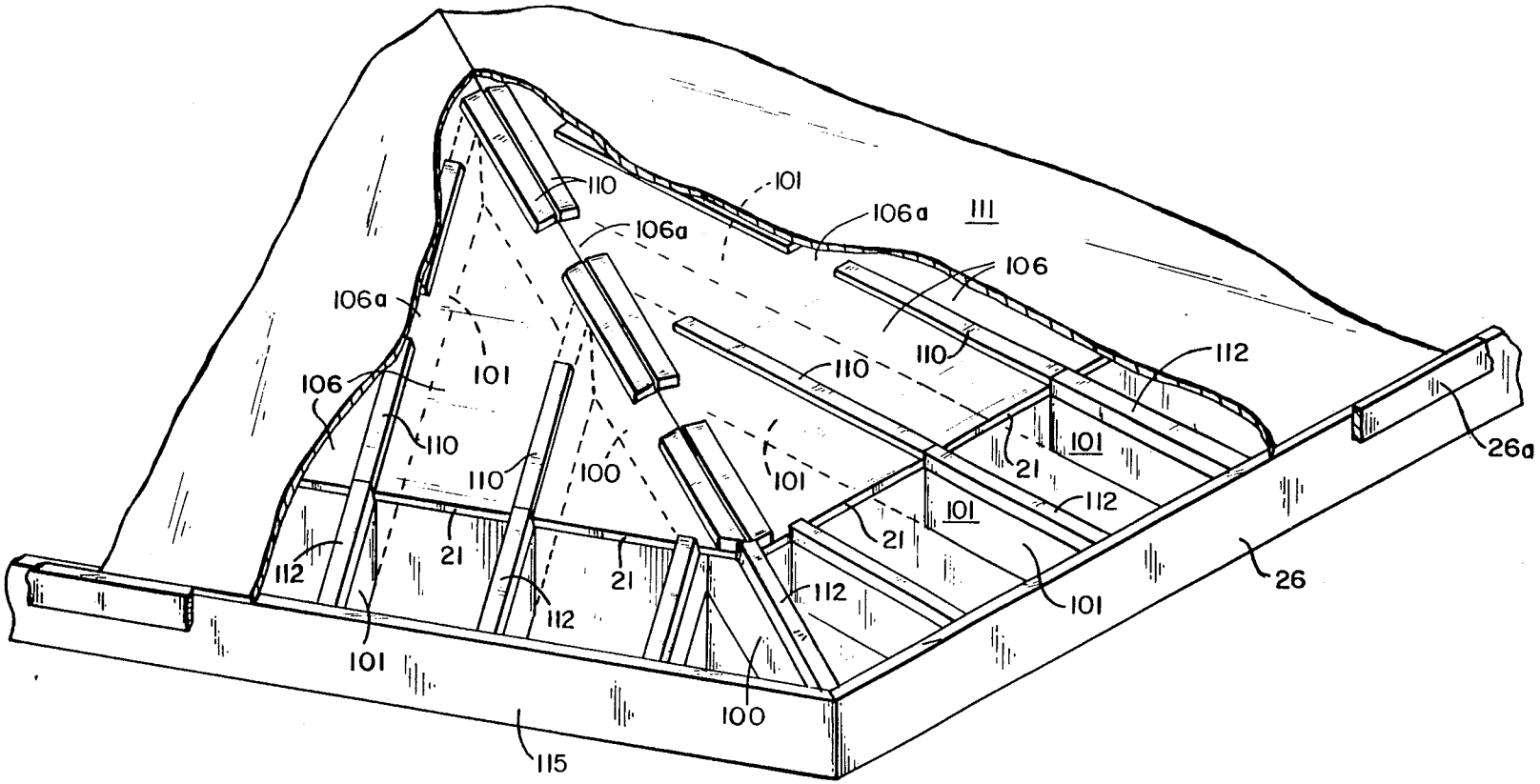

Another detailed modification of the invention which embodies many of the concepts of the form shown in FIGS. 7, 8 and 9, is illustrated in FIG. 10, which shows a conventional hip roof construction. In this form of the invention, a hip rafter 100 is illustrated with a plurality of jack rafters 101 extending downwardly therefrom. Insulation is packed in the space defined by the hip rafters and the respective jack rafters 101 in the conventional way, and suitable insulation board 105 is provided to seal the insulation compartments.

Air vent spaces 106 are defined above the insulation board 105 by the spacer/firring strips 110 which are applied over the rafters 100 and 101. Suitable decking, such as the plywood decking 111, is laid over the spacer strips 110 to enclose the vent spaces 106 and conventional roofing (not shown) in FIG. 10 is applied to the plywood decking 111. The rafters 101 are notched into the plate members 14 at the top of the wall and extend outwardly beyond the wall to support the eave structure as illustrated.

A facia board 26 and a facia board 26*a* are shown at the outer edge of the eaves and are supported by the ends of the rafters 100 and 101. Eave firring strips 112 extend out to the facia board and overlie the rafters 100 and 101 as indicated. The firring strips 110 overlying the jack rafters 101 terminate in spaced relation providing cross passages 106*a* which the hip rafter 100 to permit air flow between adjacent spaces 106 at the upper ends thereof so that each of the vent spaces 106 are in communication with the adjacent vent space 106, so that a complete communication between all the vent spaces 106 is permitted through cross passages 106*a* in the same manner as is illustrated in FIGS. 7, 8 and 9.

Suitable vent openings 24 are provided along the outer marginal edge portion of the soffit as shown in fragmentary sectional view 11, so that outside air is free to pass up into the vent spaces 106 and from one vent space 106 to the next through cross passages 106*a* as previously described. This maintains the roof surface at approximately the same temperature as the outside air without necessitating a ridge vent construction or other venting means at the upper ends of the passages. The communication at the upper ends of the vent spaces has proved to provide sufficient circulation to maintain this outside air temperature condition.

The construction illustrated represents a hip roof condition. However the same general construction details would be present in a roof valley condition, so that the communicating vent spaces would prevent ice build-up from forming in the valleys.

What is claimed is:

1. A vented roof construction including, an insulated inner roof structure, an intermediate layer sealingly covering the insulated inner roof structure, an outer roof sheeting layer spaced outwardly from the intermediate layer and providing vent passage means therebetween, venting means at the two ends of said passage means to provide vented areas at the ends of the passage means and produce circulation therethrough and remove condensation from the top surface of the intermediate layer, spacing and supporting means interposed between said two layers to provide support for the outer roof sheeting layer while maintaining the vent passage means therebetween, wherein said spacing means comprises a plurality of spaced-apart firring strips extending between the proximate end portions of said layers and defining individual passages and said venting means communicating with the ends of said individual passages, and said firring strips terminating in spaced relation to the ends of said passages providing cross passages to afford communication between adjacent passages, said venting means communicating with the cross passages to eliminate dead air space from the roof structure.

2. The structure set forth in claim 1 wherein said insulated inner roof structure includes a plurality of spaced-apart parallel structural members extending substantially from one vented area of the roof to the other vented area thereof wherein said spacing firring strips generally overlie in registration with said structural members to provide support for the outer roof sheeting layer while defining said vent passage means.

3. The structure set forth in claim 1 wherein the intermediate layer comprises insulating board material to provide the desired sealed covering as well as additional insulation to the inner roof structure.

4. A roof construction having a vented air space therein and including, an insulated inner roof structure, an intermediate sealing layer sealingly covering the insulated roof structure, an outer roof sheeting layer spaced outwardly from the intermediate layer and providing vent passages between said two layers, and venting means only at the lower ends of said passage means to provide outside air flow into said passage means only from said lower passage ends and cross ventilation spaces between adjacent vent passages to provide circulation through said vent passages and maintain the temperature of the outer roof structure at substantially the same temperature as the outside ambient air.

5. The structure set forth in claim 4 and spacing and supporting means interposed between said two layers to provide support for the outer roof sheeting layer while maintaining the vent passage means therebetween.

6. The structure set forth in claim 4 wherein said spacing means comprises a plurality of spaced-apart firring strips extending between the proximate end portions of said layers and defining individual passages and said venting means communicating with the ends of said individual passages.

7. The structure set forth in claim 6 wherein said insulated inner roof structure includes a plurality of spaced-apart parallel structural members extending substantially from one vented area of the roof to the other vented area thereof wherein said spacing firring strips generally overlie in registration with said structural members to provide support for the outer roof sheeting layer while defining said vent passage means.

* * * * *